United States Patent [19]

Hoffmann

[11] Patent Number: 4,556,071

[45] Date of Patent: Dec. 3, 1985

[54] METHOD AND APPARATUS FOR FORMING ROD-SHAPED ARTICLES OF THE TOBACCO PROCESSING INDUSTRY

[75] Inventor: Gottfried Hoffmann, Schwarzenbek, Fed. Rep. of Germany

[73] Assignee: Hauni-Werke Körber & Co. KG, Hamburg, Fed. Rep. of Germany

[21] Appl. No.: 575,168

[22] Filed: Jan. 30, 1984

[30] Foreign Application Priority Data

Feb. 4, 1983 [DE] Fed. Rep. of Germany ..... 3303777
Dec. 16, 1983 [DE] Fed. Rep. of Germany ..... 3345609

[51] Int. Cl.[4] ..... A24C 5/14
[52] U.S. Cl. ..... 131/84.4; 131/906
[58] Field of Search ..... 131/84 C, 906

[56] References Cited

U.S. PATENT DOCUMENTS 3,132,650 5/1964 Richter ..... 131/84 C
3,640,135 2/1972 Tomlyasu ..... 73/228
3,769,989 11/1973 Labbe et al. ..... 131/84 C
3,825,152 7/1974 Davis ..... 131/109 R
4,185,644 1/1980 Heitmann et al. ..... 131/84 C
4,190,061 2/1980 Heitmann et al. ..... 131/84 C
4,235,248 11/1980 Schumacher ..... 131/108
4,284,087 8/1981 Reuland ..... 131/84 C

*Primary Examiner*—V. Millin
*Attorney, Agent, or Firm*—Peter K. Kontler

[57] ABSTRACT

The density of the trimmed tobacco stream in a cigarette rod making machine is monitored and the distance between the trimming plane and the conveyor for the tobacco stream is varied in dependency on deviations of the monitored density from an optimum density. The variations in the distance between the trimming plane and the conveyor are monitored and the signals denoting such variations are used to adjust the rate of tobacco feed into the stream building zone of the machine. The rate of feed is reduced when the distance between the trimming plane and the conveyor is reduced and vice versa. The quantity of removed surplus is monitored and the rate of tobacco fed is or can be regulated in response to signals denoting changes in the quantity of removed surplus. Alternatively, monitoring of the surplus can be used solely to generate signals which denote that the quantity of surplus tobacco is outside of a preselected range.

24 Claims, 4 Drawing Figures

METHOD AND APPARATUS FOR FORMING ROD-SHAPED ARTICLES OF THE TOBACCO PROCESSING INDUSTRY

BACKGROUND OF THE INVENTION

The present invention relates to a method and apparatus for forming rod-shaped articles of the tobacco processing industry, and more particularly to improvements in a method and apparatus for forming a continuous filler which is thereupon wrapped and subdivided into rod-shaped articles of selected length.

It is well known to make a continuous cigarette rod by admitting particles of tobacco into an elongated path which is defined by a foraminous conveyor and wherein the thus formed stream is held and caused to advance with the conveyor by suction. The surplus of tobacco particles is removed by a trimming device and the trimmed stream (filler) is thereupon draped into a web of cigarette paper or other suitable material and is subdivided by a cutoff to yield plain cigarettes, cigars or cigarillos of desired length. It is also known to monitor the density of the filler (either prior or subsequent to draping) and to regulate the position of the trimming device with reference to the conveyor (i.e., the rate of removal of tobacco particles from the stream) in dependency on fluctuations of the monitored density so as to ensure that the density of the filler will match or closely approximate a predetermined value. Such mode of making rod-shaped articles of the tobacco processing industry can be resorted to for the mass production of tobacco-containing products as well as for the making of certain types of filter rod sections which are thereupon united with tobacco-containing articles to form therewith filter cigarettes, cigars or cigarillos.

U.S. Pat. No. 3,132,650 discloses a cigarette rod making machine wherein the surplus which is removed by the trimming device from an unequalized tobacco stream is not returned into the distributor of the machine but is immediately admitted to the unequalized stream ahead of the trimming device. A drawback of such proposal is that the machine will produce an unsatisfactory filler if the deviation of the quantity of tobacco in the untrimmed stream from an average value will persist for a longer interval of time. Thus, the tobacco stream which approaches the trimming station will contain an excessive amount of surplus tobacco if the trimming operation involves removal of larger-than-average quantities of surplus tobacco. On the other hand, if the quantity of surplus tobacco in the untrimmed stream is below average, the filler is likely to contain less tobacco than necessary for the making of acceptable rod-shaped articles. In order to overcome such problems, the patented apparatus further comprises means for monitoring the position of the trimming plane and of utilizing the thus obtained signals for adjustment of the distributor in a sense to ensure that the surplus in the steam which is formed on the foraminous conveyor approximates or matches a preselected value, i.e., in a sense to reduce or eliminate fluctuations of surplus tobacco in the untrimmed tobacco stream.

U.S. Pat. No. 4,190,061 discloses a cigarette rod making machine wherein the surplus, which is removed by the trimming device, is monitored and the resulting signals are used to regulate the rate of tobacco feed to the stream building zone with a view to ensure that the quantity of surplus tobacco will remain at least substantially constant. The monitoring of the surplus involves generating a signal which is indicative of the difference between the height of the untrimmed stream and the distance of the trimming plane from the foraminous conveyor for the tobacco stream. The distance between the trimming plane and the conveyor is ascertained by monitoring the distance between the trimming device and the conveyor.

It has been found that such prior proposals fail to ensure the formation of a highly satisfactory filler stream, especially as concerns its density and the quantity of circulated surplus tobacco.

OBJECTS AND SUMMARY OF THE INVENTION

An object of the invention is to provide a novel and improved method of regulating the rate of removal of surplus tobacco from a continuous tobacco stream and the rate of circulation of surplus tobacco with a view to ensure that the density of the trimmed stream will match or closely approximate an optimum value.

Another object of the invention is to provide a novel and improved method of regulating the circulation, quantity and other parameters of the mass of tobacco particles which are removed as a surplus by the trimming device of a cigarette rod making or like machine.

A further object of the invention is to provide a method which can be resorted to for highly economical operation of a cigarette rod making or like machine and which ensures the making of a trimmed or equalized stream that is more homogeneous than the trimmed streams which are obtainable in accordance with heretofore known proposals.

An additional object of the invention is to provide an apparatus which can be utilized for the practice of the above outlined method.

Another object of the invention is to provide the apparatus with novel and improved means for regulating the rate of circulation of surplus tobacco to the trimming station and thence back to the distributor of a cigarette rod making or like machine.

Still another object of the invention is to provide an apparatus which can be utilized in existing cigarette rod making and like machines for the production of superior rod-like fillers.

A further object of the invention is to provide the apparatus with novel and improved means for converting an unequalized tobacco stream into a continuous rod-like filler of optimum density.

One feature of the invention resides in the provision of a method of forming a filler of fibrous material, particularly tobacco, on a driven air-permeable conveyor which defines an elongated path. The method comprises the steps of continuously feeding fibrous material with a surplus over that which is required in the filler at a variable rate into a first portion of the path and attracting the fibrous material to the conveyor by suction so that the resulting stream is densified and advances along the path, removing the surplus from the stream and thereby converting the stream into a filler in a second portion of the path downstream of the first portion including removing fibrous material that extends beyond a predetermined plane which is disposed at a variable distance from the conveyor, monitoring the density of the filler and changing the distance between the plane and the conveyor when the monitored density deviates from a predetermined value, monitoring the distance between the plane and the conveyor (i.e., the height of the filler), and varying the rate of feed of fibrous material into the first portion of the path as a function of changes in the distance between the plane and the conveyor. The varying step includes increasing the rate of feed of fibrous material when the distance is changed as a result of a drop of density below the predetermined value and reducing the rate of feed when the distance is changed as a result of a rise of density above the predetermined value. The method preferably further comprises the step of comparing the monitored distance with a predetermined distance and the varying step then includes increasing or reducing the rate of feed of fibrous material when the difference between the monitored distance and the predetermined distance exceeds a preselected value.

Each variation of the rate of feed of fibrous material takes up a predetermined interval of time which is required to stabilize the newly selected rate of feed, and the method preferably further comprises the step of delaying the next-following variation of the rate of feed following the immediately preceding variation by an interval whose duration at least matches that of the predetermined interval.

It is preferred to monitor the quantity of the removed surplus and to generate a signal when the removed quantity is outside of a predetermined range.

The method can further comprise the steps of accumulating the removed surplus into a second stream, continuously monitoring the quantity of fibrous material in the second stream, and generating a signal when the monitored quantity of surplus fibrous material is outside of a predetermined range.

The density monitoring step can comprise directing X-rays or beta rays against successive increments of the filler and ascertaining the extent of penetration of such rays through the filler.

The surplus removing step preferably includes mechanically clamping the fibrous material in the predetermined plane by moving clamping instrumentalities and separating from the stream that fibrous material which extends beyond the predetermined plane in a direction away from the conveyor.

It is preferred to temporarily reduce the surplus of fibrous material in the stream which is formed in the first portion of the path during the initial stage of stream formation.

The signals which are generated as a result of monitoring the quantity of surplus fibrous material in the second stream can be compared with signals denoting the monitored distance of the predetermined plane from the conveyor, and the rate of feed of fibrous material into the first portion of the path can be varied when the characteristics of signals denoting the monitored quantity of surplus fibrous material in the second stream deviate from the characteristics of signals denoting the distance between the predetermined plane and the conveyor to a predetermined extent. The adjustment of the rate of feed takes place or can take place with a view to maintain the quantity of fibrous material in the second stream at or close to a preselected value.

Another feature of the invention resides in the provision of an apparatus for forming a filler of fibrous material, such as tobacco. The apparatus comprises an air-permeable conveyor which defines an elongated path, a suction chamber at one side of the conveyor opposite the elongated path, a source of fibrous material, adjustable means for feeding fibrous material with a surplus from the source into a first portion of the path at the other side of the conveyor so that the material adheres to the conveyor by suction and forms a stream which advances along the path, a trimming device having means for removing the surplus of fibrous material from the stream in a plane which is disposed at a variable distance from the other side of the conveyor and for thereby converting the stream into a filler, means for monitoring the density of the filler downstream of the trimming device, as considered in the direction of movement of fibrous material along the path, and for generating first signals denoting the monitored density of the filler, means for adjusting the trimming device in response to the first signals so as to move the predetermined plane nearer to or further away from the conveyor when the monitored density of the filler deviates from a predetermined value, means for monitoring the distance between the predetermined plane and the conveyor and for generating second signals denoting the monitored distance, and means for adjusting the feeding means in response to the second signals. The means for adjusting the feeding means is preferably arranged to increase the rate of feed when the distance between the predetermined plane and the conveyor is altered as a result of detection of a drop of density below the predetermined value and to reduce the rate of feed when the aforementioned distance is altered as a result of detection of a rise of density above the predetermined value.

The adjusting means preferably includes a source of reference signals whose characteristics are indicative of a predetermined distance between the predetermined plane and the conveyor, means for comparing the characteristics of the second signals with those of the reference signals, and means for carrying out the adjustment of the feeding means when the characteristics of the second signals deviate from those of the reference signals to a predetermined extent.

Each adjustment of the feeding means takes up a predetermined interval of time, and the apparatus preferably further comprises means (such as suitable timer) for delaying the next-following adjustment of each two consecutive adjustments of the feeding means for an interval of time which at least matches the predetermined interval. This allows for a stabilization of the freshly adjusted rate of feed prior to next adjustment of such rate.

The apparatus preferably further comprises means for monitoring the quantity of the removed surplus and means for generating visible, audible or otherwise detectable signals when the monitored quantity of the removed surplus is outside of a predetermined range of acceptable quantities.

The density monitoring means can comprise a source of X-rays or beta rays adjacent to one side of the filler and arranged to direct radiation against the filler, and means (e.g., an ionization chamber) for ascertaining the intensity of radiation which penetrates through the filler.

The trimming device can comprise two mobile clamping members (e.g., two discs rotating about parallel axes) which serve to engage the fibrous material in the predetermined plane, and means (e.g., a rotating paddle wheel or a rotating brush) for segregating from the stream fibrous material which extends beyond the predetermined plane in a direction away from the conveyor in the region where the stream is engaged by the clamping members.

The apparatus can further comprise means for temporarily reducing the rate of feed of fibrous material into the first portion of the path upon starting of the feeding means.

Still further, the signals which are generated as a result of monitoring the quantity of removed surplus material can be compared with signals which denote the monitored distance between the predetermined plane and the conveyor so that the latter signals constitute reference signals. The adjusting means can be arranged to adjust the rate of feed of fibrous material when the characteristics of signals denoting the quantity of removed surplus deviate from the characteristics of signals denoting the monitored distance between the predetermined plane and the conveyor to a predetermined extent so that the quantity of the removed surplus fluctuates as a function of fluctuations of the distance between the predetermined plane and the conveyor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
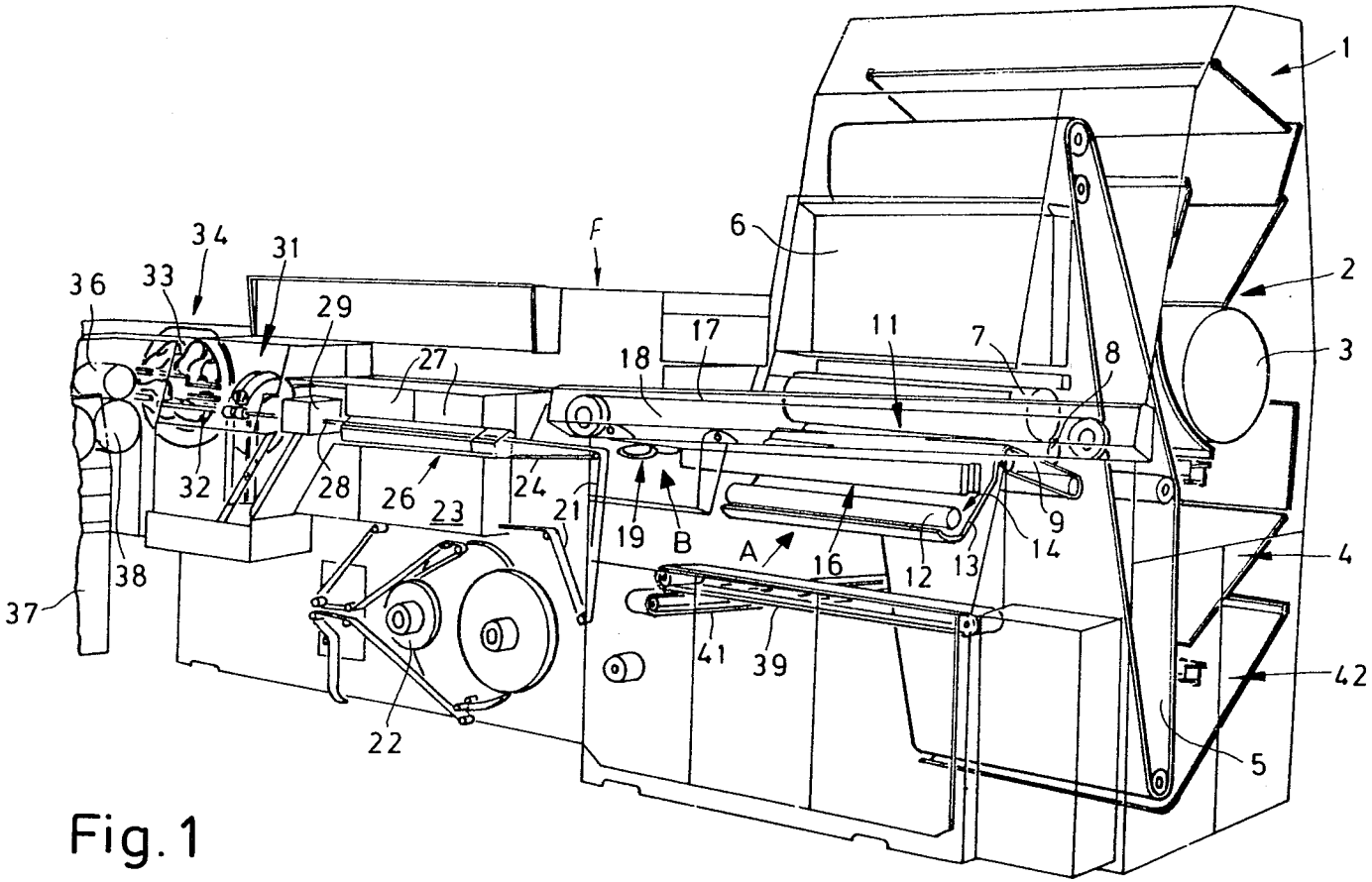
FIG. 1 is a schematic perspective view of a cigarette rod making machine including an apparatus which embodies one form of the invention.

Referring first to FIG. 1, there is shown a cigarette rod making machine of the type known as PROTOS (manufactured by the assignee of the present application). The machine comprises a frame F wherein a pivotable gate 1 is actuatable to admit batches of tobacco particles from the discharge end of a pneumatic conveyor into a first or primary distributor 2 which contains a substantial supply of tobacco particles and whose bottom wall is constituted by a rotary drum-shaped carded conveyor 3 serving to transfer metered quantities of tobacco particles into the magazine 4 of a second or main distributor. One side wall of the magazine 4 is constituted by the upwardly moving reach of an endless belt conveyor 5 having equidistant pockets (not specifically shown) serving to withdraw batches of tobacco particles from the supply in the magazine 4 and to dump such batches seriatim through the open upper end of a source of fibrous material here shown as an upright duct 6. The manner in which the conveyor 5 draws batches of tobacco particles from the magazine 4 and the manner in which such batches are dumped into the duct 6 are disclosed in commonly owned U.S. Pat. Nos. 4,185,644 to Heitmann et al. and 4,235,248 to Schumacher. A variable-speed drum-shaped carded conveyor 7 withdraws tobacco particles at a variable rate from the bottom of the column of tobacoo in the duct 6 and cooperates with a rapidly rotating picker roller 8 which expels the particles from the carding and showers them onto the upper reach of an apron conveyor 9 driven at a constant speed. The tobacco stream which is expelled from the carding of the conveyor 7 is uniform and forms on the upper reach of the conveyor 9 a wide carpet whose leading end is propelled against a substantially vertical curtain 66 (FIG. 2) of compressed air issuing from a plenum chamber 67 whose inlet is connected to the pressure side of a blower 68. The plenum chamber 67 and the blower 68 constitute component parts of a tobacco sifting or classifying device 11. Heavier particles of tobacco penetrate through the curtain 66 and accumulate in an intercepting vessel 69*a* containing a rotating feed screw 69 which evacuates the accumulated heavier particles, either periodically or continuously. The heavier particles include fragments of tobacco ribs, birds' eyes and like parts. The lighter tobacco particles (primarily shreds of tobacco leaf laminae) are deflected by the air jets of the curtain 66 and enter a funnel 14 which is defined by an arcuate sheet metal wall 13 and a rotary drum-shaped carded conveyor 12. The carding of the conveyor 12 propels the lightweight tobacco particles against the underside of the lower reach of an endless air-permeable belt conveyor 17. The upper side of the lower reach of the conveyor 17 is adjacent to the air-permeable bottom wall of a stationary suction chamber 18 (see also FIG. 3) which is connected by a suction generating device 71 by a conduit 70. The streamlets of air which flow upwardly through the lower reach of the conveyor 17 attract the ascending particles of tobacco in a stream building zone A wherein the particles form a growing tobacco stream 92 which adheres to the underside of the lower reach of the conveyor 17 due to the provision of the suction chamber 18 and advances with the conveyor 17 along an elongated slightly downwardly sloping path in a tobacco channel 16. The lower reach of the conveyor 17 constitutes the end wall or top wall of the channel 16 whose width determines the width of the tobacco stream 92.

Figure 3:
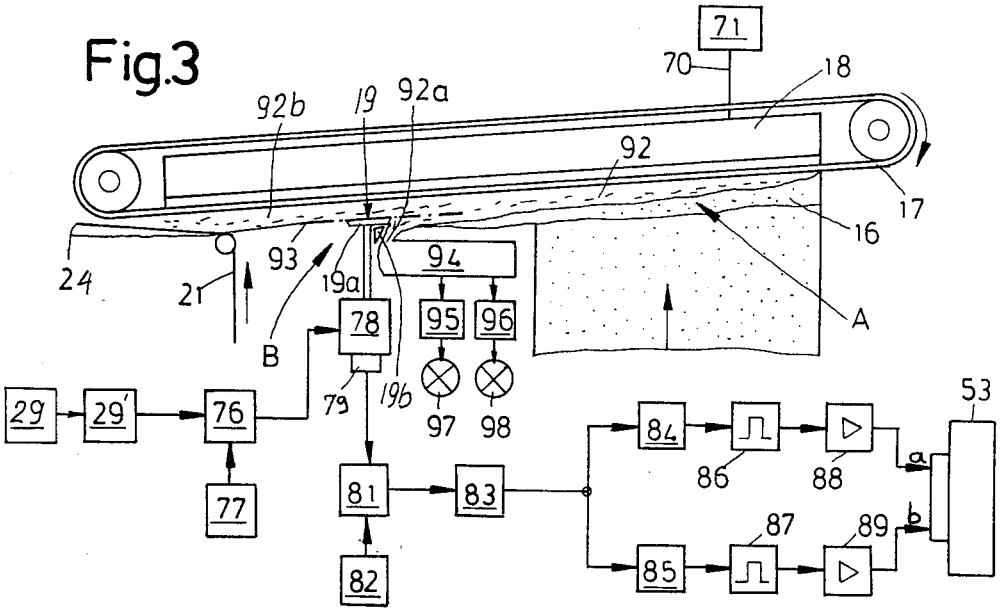
FIG. 3 is an elevational view of the conveyor with the stream building and trimming stations and a diagrammatic view of the associated adjusting means.

A trimming or equalizing device 19 is adjacent to the path of the stream 92 downstream of the stream building zone A (at a surplus removing station B) and includes one or more rotary tobacco clamping discs 19*a* cooperating with a segregating element 19*b* in the form of a rotating brush or paddle wheel to remove all tobacco particles which extend downwardly beyond a variable equalizing plane or location 93 shown in FIG. 3. The qualizing plane 92 is variable (namely, its distance from the underside of the lower reach of the conveyor 17 is variable) because the entire trimming device 19 is movable up and down (i.e., toward and away from the conveyor 17) by a level adjusting means including a reversible electric motor 78.

The provision of a trimming device 19 is necessary because the tobacco stream 92 which is formed on the conveyor 17 at the station A contains a surplus (92*a*) of tobacco particles, namely a surplus in such quantities that the distance between the deepmost portions of unavoidable valleys at the underside of the stream 92 and the lower reach of the conveyor 17 exceeds the distance between the conveyor 17 and the plane 93.

The equalized tobacco stream (filler 92*b*) is thereupon deposited on the upper side of an endless belt conveyor 24, and more particularly on a continuous web 21 of cigarette paper which is drawn off a reel 22 and is caused to pass through a conventional imprinting mechanism 23 serving to apply to spaced-apart portions of the web 21 information such as the trademark of the manufacturer, the name of the manufacturer, the brand name of the article and/or others. The speed of the web 21 on the conveyor 24 matches the speed of the filler 92*b*, and the web 21 is thereupon draped around the filler in a wrapping mechanism 26 in such a way that one marginal portion of the web extends tangentially of and away from the filler stream. The latter is compacted during passage through the wrapping mechanism 26 so that it forms a solid cylindrical rod. The outwardly extending marginal portion of the draped web 21 is coated with adhesive by a suitable paster (not shown) and is folded over the other marginal portion to form therewith a seam extending in parallelism with the axis of the resulting cigarette rod 28. The seam is heated or cooled by a tandem sealer 27, depending on the nature of adhesive paste. This ensures that the seam does not open during passage of the rod 28 through a cutoff 31 which subdivides the rod into plain cigarettes 32 of double unit length. The density of successive increments of the filler 92*b* in the cigarette rod 28 is monitored by a density monitoring device 29 which is mounted in the frame F ahead of the cutoff 31. The cigarettes 32 form a single file and are engaged and transported by successive orbiting arms 33 of a transfer device 34 which deposits such cigarettes on a rotary drum-shaped conveyor 36 of a filter tipping machine 37, e.g., a machine known as MAX or MAX S (both manufactured by the assignee of the present application). The machine 37 comprises a rotary disc-shaped cutter 38 which subdivides each cigarette 32 into two coaxial plain cigarettes of unit length, and such cigarettes are thereupon assembled with filter rod sections to form filter cigarettes of unit length or double unit length.

FIG. 1 further shows belt conveyors 39 and 41 which serve to transport the removed surplus 92*a* of tobacco particles from the station B back to the secondary or main distributor, namely into a magazine 42 which is disposed at a level below the magazine 4 and is adjacent to the ascending reach of the conveyor 5 so that the pockets of this conveyor can remove from the magazine 42 small batches of returned discard tobacco or short tobacco before they advance into and remove shreds and fragments of ribs (if any) from the magazine 4.

The density monitoring device 29 can operate with X-rays (as disclosed in U.S. Pat. No. 3,056,026 to Bigelow) or with beta rays. In each instance, the rays are caused to penetrate into the running filler 92*b* of the cigarette rod 28 and the intensity of those rays which have penetrated through the filler is ascertained by a suitable ionization chamber serving to generate electric signals whose intensity or another characteristic is indicative of the density of successive increments of the filler 92*b* in the cigarette rod 28. As a rule, the apparatus also comprises a suitable integrating or summing circuit 29' which furnishes signals denoting the average density of selected unit lengths of the condensed filler 92*b*. Thus, the signals which are transmitted by the output of the summing or integrating circuit 29' denote the density or mass of successive unit lengths of the cigarette rod 28 (e.g., the density of the fillers of successive coherent plain cigarettes of unit length).

FIG. 3 shows the tobacco channel 16 in the regions of the stream building zone A and the trimming or equalizing station B. The suction chamber 18 extends along the upper side of the lower reach of the conveyor 17 above the zone A and station B as well as on toward and above the upper reach of the conveyor 24, i.e., all the way to the station where successive increments of the filler 92 come into contact with the web 21.

The clamping discs 19*a* of the trimming device 19 (such discs can be seen in U.S. Pat. No. 3,769,989) engage the untrimmed stream 92 in the aforementioned plane 93 and cooperate with the rotary brush or paddle wheel 19*b* to remove the surplus which extends below such plane. The peripheral speed of the clamping discs 19*a* matches or closely approximates the speed of movement of the conveyor 17. The removed surplus 92*a* forms a stream which is caused to pass through a monitoring device 94 which ascertains the quantity of removed surplus per unit of time or per unit length of the stream 92 and allows the monitored surplus to descend onto the conveyor 39 of FIG. 1 which, in turn, delivers the surplus onto the conveyor 41 for introduction into the magazine 42 of the main distributor of the cigarette rod making machine. The manner in which the monitoring device 94 determines the quantity of removed surplus can be the same as or similar to that disclosed in commonly owned U.S. Pat. No. 3,825,152 to David et al. This patent discloses a pivotable or otherwise movable barrier or baffle which is acted upon by successive increments of the stream of removed surplus tobacco, and the displacement of the baffle is ascertained to form a signal which is indicative of the quantity of surplus tobacco. Another suitable monitoring device which can be used to ascertain the quantity of removed surplus tobacco is disclosed in U.S. Pat. No. 3,640,135 to Tomiyasu et al.

The signals which are generated by the monitoring device 94 are transmitted to two threshold circuits 95 and 96. The circuit 95 generates a signal or permits the signal from the monitoring device 94 to reach a light source 97 which produces a detectable signal when the quantity of removed surplus tobacco drops below a permissible minimum value. The threshold circuit 96 causes or permits a light source 98 to generate a detectable signal when the quantity of removed surplus tobacco exceeds a predetermined maximum permissible value. Such signals indicate to the attendants that it is necessary to select a different neutral or normal position for the level of the trimming device 19 and/or to carry out another adjustment in the cigarette rod making machine.

The level of the trimming device 19 is adjusted by the aforementioned reversible motor 78 in response to signals which are transmitted by the ionization chamber of the monitoring device 29 and denote the density of the compacted filler in the tubular wrapper of the cigarette rod 28. The signal at the output of the monitoring device 29 is transmitted (via integrating circuit 29') to a signal comparing stage 76 which further receives a reference signal from a source 77. If the intensity or another characteristic of the signal from the monitoring device 29 deviates appreciably from the reference signal which is furnished by the source 77 (e.g., an adjustable potentiometer), the motor 78 is caused to move the trimming device 19 (and hence the plane 93) up or down in order to increase or reduce the rate of removal of surplus tobacco from the tobacco stream 92.

The reference character 79 denotes in FIG. 3 a device which monitors the level of the trimming device 19, i.e., the distance between the plane 93 and the underside of the conveyor 17 for the tobacco stream 92. Signals which are generated by the monitoring device 79 are transmitted to a signal comparing stage 81 which further receives a reference signal from a source 82. The output of the stage 81 transmits a signal to a time delay unit 83. The monitoring device 79 may be of the type known as LINOTAST (manufactured and sold by the assignee of the present application).

The output of the time delay unit 83 transmits signals at preselected intervals of two threshold circuits 84 and 85. The intensities and the signs of the signals at the output of the timer 83 are indicative of upward or downward deviations of the level of the plane 93 from a predetermined level such as is indicated by the reference signal from the source 82. The length of intervals at which the time delay unit 83 transmits signals from the signal comparing stage 81 to the threshold circuits 84 and 85 is selected in such a way that each such interval suffices to allow for a stabilization of the rate of feed of tobacco particles by the carded conveyor 7 onto the apron conveyor 9 and thence into the stream building zone A via funnle 14 and tobacco channel 16 before the conveyor 7 receives a fresh signal to change the rate of tobacco feed to the conveyor 17. The signals which are transmitted by the threshold circuit 84 or 85 are used to adjust the speed of the conveyor 7 and hence the rate of feed of tobacco particles into the channel 16. Relatively long intervals between successive adjustments of the RPM of the conveyor 7 are desirable and advantageous because such mode of operation prevents continuous fluctuations of the rate of feed of tobacco particles into the stream building zone A. Of course, the intervals of actual signal transmission from the time delay unit 83 to the threshold circuits 84 and 85 may be much longer since the threshold circuits 84 and 85 receive signals only when the monitored position or level of the plane 93 deviates from the selected average or standard position (depending on the setting of the source 82 of reference signals).

The threshold circuit 84 transmits a signal to a pulse shaper 86 when the intensity of the signal at the output of the time delay unit 83 is below a preselected minimum value, and the threshold circuit 85 transmits a signal to a pulse shaper 87 when the intensity of the signal at the output of the unit 83 exceeds a maximum permissible value. The pulse shapers 86 and 87 respectively transmit signals to amplifiers 88, 89 which, in turn, transmit amplified signals to the corresponding inputs a and b of a servomotor 53. The pulse shapers 86 and 87 are designed to transmit signals of predetermined shape and intensity.

Figure 2:
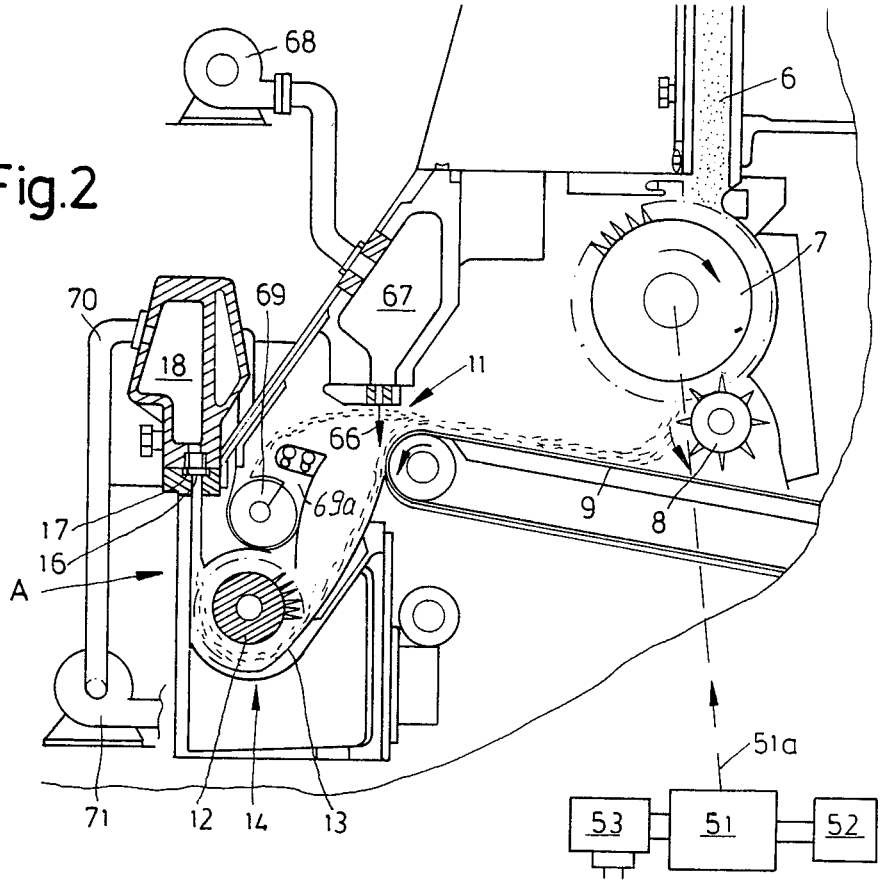
FIG. 2 is an enlarged view of a detail in the apparatus of FIG. 1, showing the means for feeding tobacco particles to the conveyor and means for adjusting the feeding means.

The manner in which the servomotor 53 can influence the RPM of the carded conveyor 7 is shown in FIG. 2. When the input a of the servomotor 53 receives a signal from the amplifier 88, the rotor of the servomotor 53 is indexed by an increment in one direction (e.g., clockwise). Analogously, when the amplifier 89 transmits a signal to the input b of the servomotor 53, the rotor of this servomotor turns by an increment in the opposite direction (counterclockwise). The servomotor 53 serves to adjust the ratio of a variable speed transmission 51 which drives the shaft of the conveyor 7. The operative connection (e.g., a toothed belt drive) between the output shaft of the transmission 51 and the shaft of the conveyor 7 is indicated schematically by a phantom line 51*a*. The reference character 52 denotes a schematically illustrated main prime mover of the cigarette rod making machine. In lieu of a belt transmission, the reference character 51*a* can also denote the output shaft of the transmission 51; such output shaft then carries the carded conveyor 7 which can vary the rate of tobacco feed toward and into the tobacco channel 16.

The operation of the cigarette rod making machine is as follows:

If the density monitoring device 29 ascertains that the density of the filler 92*b* in the rod 28 is too low, i.e., that the filler contains an insufficient quantity of tobacco per unit length, the signal which the ionization chamber of the monitoring device 29 transmits to the signal comparing stage 76 deviates from the reference signal which is furnished by the source 77. The output of the stage 76 transmits a signal which causes the servomotor 78 to adjust the level of the plane 93 (i.e., to move the trimming device 19 down) so that the rate of removal of surplus tobacco is reduced and the filler 92*b* contains a larger quantity of tobacco particles per unit length. Since the filler 92*b* is compacted to a predetermined cross-section irrespective of the quantity of tobacco particles per unit length, the density of the filler in the rod 28 is increased automatically in response to lowering of the plane 93.

The monitoring device 79 detects the change in the level of the plane 93 and transmits a corresponding signal to the signal comparing stage 81 which compares such signal with the reference signal from the source 82 and transmits a signal to the time delay unit 83. If the deviation of the intensity or another characteristic of the signal from the unit 83 exceeds a certain preselected value, the threshold circuit 84 transmits a signal which is shaped at 86 and amplified at 88 before it reaches the input a of the servomotor 53. The angular position of the rotor of the servomotor 53 is thereby changed by an increment to effect an appropriate adjustment of the ratio of the transmission 51 which drives the conveyor 7. The speed of the conveyor 7 is increased with attendant increase in the rate of tobacco feed into the channel 16 below the lower reach of the conveyor 17. As explained above, the particles of tobacco which are propelled by the picker roller 8 onto the conveyor 9 are thereupon propelled across the curtain 66 of compressed air issuing from the orifices in the bottom wall of the plenum chamber 67 whereby the heavier particles retain their trajectories (determined by the speed of the conveyor 9) but the lighter particles descend into the funnel 14 and into the range of the carding on the conveyor 12 which propels such particles into the stream building zone A. The feed screw 69 removes the intercepted heavier tobacco particles from the receptacle 69*a*. The speed of the carded conveyor 12 is sufficiently high to ensure predictable propulsion of tobacco particles into the channel 16 so that the particles form a growing tobacco stream which adheres to the underside of the lower reach of the conveyor 17 under the action of suction in the chamber 18 and the stream 92 shares the movement of the lower reach to be trimmed at 19 for the purpose of being relieved of the surplus to the extent which is determined by the momentary level of the plane 93. The suction chamber 18 further effects at least some densification of the growing and fully grown tobacco stream.

The higher density of the filler 92*b* of the rod 28 is detected by the monitoring device 29 which transmits a corresponding signal to the stage 76 for comparison with the reference signal from 77. This results in a lifting of the trimming device 19 and an increase of the rate of removal of surplus tobacco. In other words, the plane 93 is moved nearer to its neutral position such as is determined by the setting of the source 77 of reference signals.

The new position of the trimming device 19 and of the plane 93 is detected by the monitoring device 79 which transmits a signal to the stage 81 for comparison with the reference signal from the source 82 and for transmission of a corresponding signal to the time delay unit 83. The latter ensures that the transmission of a fresh signal to the threshold circuit 84 or 85, and hence a renewed change in the ratio of the transmission 53, can be effected only after a certain interval which suffices to allow for a stabilization of the previously adjusted different rate of feed of tobacco particles. If the signal at the output of the time delay unit 83 indicates that the density of the filler in the rod 28 is still too low (in spite of the incremental increase in the RPM of the conveyor 7), the RPM of this conveyor is increased again and the rate of tobacco feed into the stream building zone A is increased accordingly. The just described sequence of steps can be repeated again and again until the density of the filler 92*b* in the rod 28 reaches the desired value.

If the filler 92*b* in the cigarette rod 28 is too dense, i.e., if the monitoring device 29 ascertains that the weight or mass of the filler in the rod 28 is excessive, the output of the signal comparing stage 76 transmits a signal of opposite polarity so that the servomotor 78 lifts the trimming device 19 to thereby move the plane 93 nearer to the lower reach of the conveyor 17. Thus, the trimming device 19 is lifted above its neutral position and the rate of removal of surplus tobacco is increased accordingly with attendant reduction of density of the filler 92*b* in the cigarette rod 28. The monitoring device 79 transmits a signal of opposite polarity to the corresponding input of the stage 81 wherein such signal is compared with the reference signal from 82 and the signal denoting the difference between the intensities of such signals is transmitted to the time delay unit 83. The unit 83 transmits a corresponding signal (with the aforediscussed delay) to the threshold circuit 85 which transmits a signal to the input b of the servomotor 53 via pulse shaper 87 and amplifier 88. The servomotor 53 effects an incremental change in the ratio of the transmission 51 so that the RPM of the conveyor 7 is reduced with attendant reduction of the rate of tobacco feed into the stream building zone A. This results in a reduction of the density of the stream 92, not only in the channel 16 (under the action of the suction chamber 18) but also in the wrapping mechanism 26. The drop of density is detected by the monitoring device 29 and a corresponding signal is transmitted to the stage 76 for comparison with the reference signal from the source 77 and attendant adjustment of the level of the trimming device 19 via servomotor 78. The same operation is repeated again (after elapse of the interval which is determined by the time delay unit 83) if a signal reduction of density does not suffice to ensure that the signal which is transmitted by the ionization chamber of the monitoring device 29 matches or closely approximates the signal from the source 77.

The just discussed mode of operation enables the trimming device 19 to change its level in response to deviations of monitored density from the selected density but the trimming device 19 exhibits a permanent tendency to reassume its normal position at a preselected distance from the conveyor 17 in which the removal of surplus can take place at an optimum rate. If this is not desired, the system for adjusting the rate of tobacco feed to the channel 16 can comprise an I-component which ensures that the altered rate of feed surplus tobacco remains unchanged even after the plane 93 is returned to a neutral position at an optimum distance from the lower reach of the conveyor 17.

The transmission 51 between the prime mover 52 of the cigarette rod making machine and the conveyor 7 constitutes but one of several suitable means for adjusting the rate of tobacco feed to the stream building zone A. Thus, the servomotor 53 or an analogous component of the adjusting means can be used to regulate the speed of a variable-speed electric motor which drives the shaft of the carded conveyor 7. The survomotor 53 can be omitted altogether if the signals from the threshold circuits 84 and 85 are utilized to regulate the speed of the electric motor by electronically increasing or reducing the control potential for the electric motor. The basic value of such control potential varies as a function of the speed of the cigarette rod making machine. A suitable follow-up control circuit can be employed to ensure that the increase or reduction of the speed of the electric motor is maintained at a constant value.

The aforediscussed adjustments of the rate of feed of surplus tobacco to the stream building zone A, especially when the conveyor 7 is driven by the just discussed variable-speed electric motor, can be used with advantage to perform the following additional advantageous and desirable function: When a cigarette rod making machine is started, the density of the filler 92*b* in the cigarette rod 28 is normally excessive. In accordance with a further feature of the improved method and apparatus, the rate of tobacco feed to the stream building zone is adjusted for the purpose of automatically reducing such rate to less than the rate of feed when the operation of the machine is normal. This compensates for the aforediscussed tendency of the machine to turn out rod-shaped articles which are too heavy and too dense during starting and acceleration of the machine to normal operating speed. All that is necessary is to regulate the control potential for the electric motor which drives the conveyor 7. The control potential (which varies with the speed of the machine) is simply reduced, immediately after starting of the main prime mover 52, below the potential which is applied in in normal operation for an interval of time which suffices to ensure that the density of the firstproduced cigarettes 32 is not excessive. Such mode of operation results in a considerable reduction of the number of rejects, especially immediately subsequent to starting of the machine.

The density of the stream 92 is increased when the rate of tobacco feed into the stream building zone A is increased. This is attributable to the presence of the suction chamber 18 at a level above the zone A. More pronounced densification of the stream 92 entails the generation of a different signal by the density monitoring device 29. Such different signal initiates the return movement of the plane 93 toward the neutral or optimum position as selected by the setting of the source 82 of reference signals. The densification of the stream 92 in the channel 16 is less pronoucned when the rate of tobacco feed from the source 6 is reduced in response to a reduction of RPM of the carded conveyor 7. This also entails a return movement of the plane 93 to the neutral position because the monitoring device 29 detects the reduction of density and transmits an appropriate signal to the servomotor 78.

Figure 4:
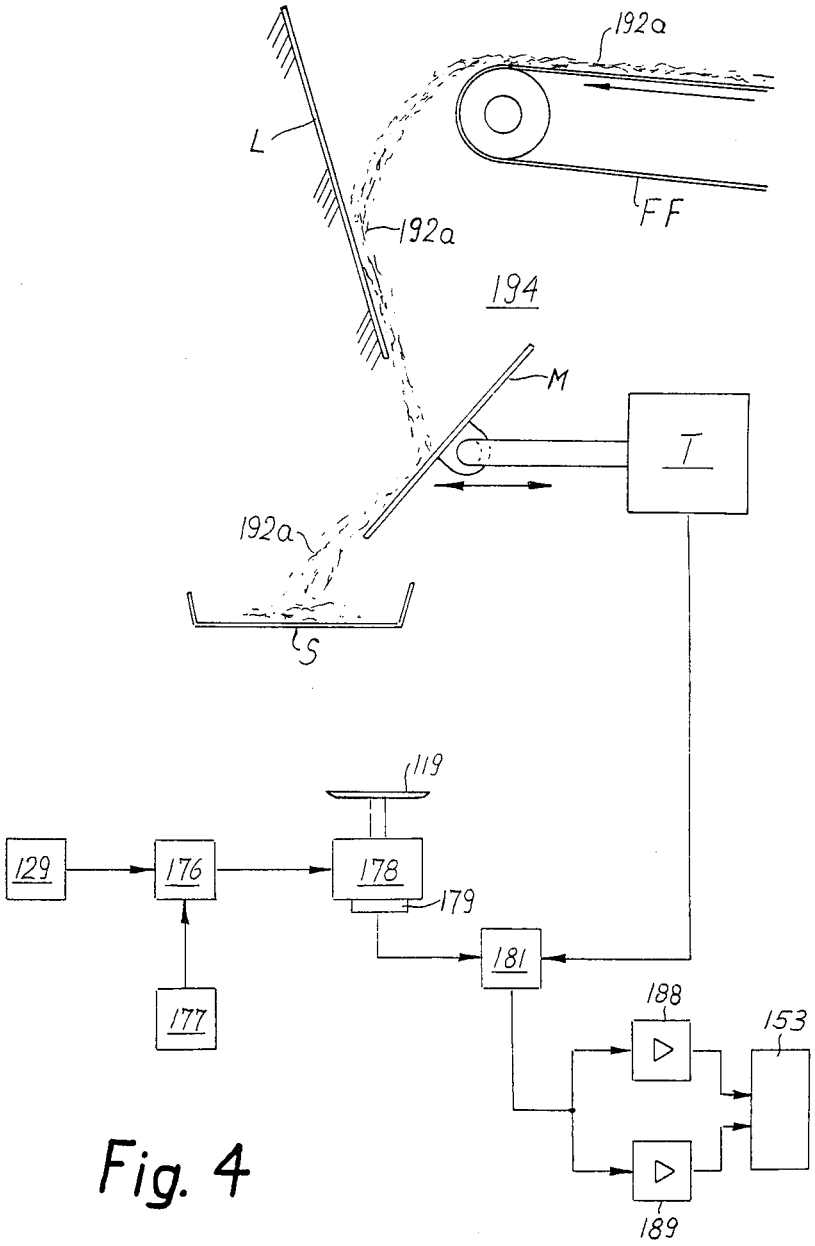
FIG. 4 is a partly elevational and partly diagrammatic view of a modified system for adjusting the rate of tobacco feed to the conveyor.

FIG. 4 shows a modified monitoring device 194 for a stream 192*a* of surplus tobacco. The signal at the output of this monitoring device is not used to merely indicate whether or not the surplus is excessive or insufficient (note the signal generating elements 97 and 98 in FIG. 3) but rather or also to regulate the rate of tobacco feed to the stream building zone A. The trimming device 119 of FIG. 4 removes the surplus from the underside of an unequalized tobacco stream (not shown) and its level is adjustable by a servomotor 178 in response to signals from a signal comparing stage 176. The latter receives signals from the density monitoring device 129 as well as from a source 177 of reference signals. The level of the trimming device 119 is monitored by the device 179 which thus monitors the level of the trimming plane corresponding to the plane 93 shown in FIG. 3.

The stream 192*a* of surplus tobacco which is removed by the trimming device 119 is advanced by a conveyor FF which propels successive increments of such stream against a plate-like deflector L. The latter changes the direction of movement of the particles which form the stream 192*a* and causes such particles to descend by gravity onto a mobile detecting plate M which directs the particles of surplus tobacco onto a vibratory conveyor S. The latter can be said to constitute an equivalent of the conveyors 39, 41 shown in FIG. 1 and serves to return the surplus into the main distributor of the cigarette rod making machine. The movements of the deflector L are monitored by a transmitter T which generates electric signals denoting the extent of displacement and hence the mass of tobacco particles in successive increments of the stream 192*a* of surplus tobacco. The details of the transmitter T can be identical with those of the transmitters disclosed in the aforementioned U.S. Pat. No. 3,640,135 to Tomiyasu et al.

The signal at the output of the transmitter T is applied to one input of a signal comparing stage 181 which further receives signals from the monitoring device 179 for the level of the trimming device 119. In this embodiment of the invention, the monitoring device 179 constitutes a source of variable reference signals for the stage 181 whose output is connected with the corresponding inputs a and b of the servomotor 153 by amplifiers 188 and 189. The connection between the output of the signal comparing stage 181 and the inputs a and b of the servomotor 153 further comprises two threshold circuits (not shown) and two pulse shapers (not shown), the same as illustrated in FIG. 3. Also, the manner in which the signals from the stage 181 are processed to vary the rate of tobacco feed to the stream building zone of the cigarette rod making machine is the same as described in connection with FIGS. 1 to 3.

If the density monitoring device 129 of FIG. 4 ascertains that the mass of the filler in the cigarette rod is too low, i.e., when the signal at the corresponding input of the stage 176 deviates from the reference signal which is furnished by the source 177, the signal at the output of the stage 176 causes the servomotor 178 to change the level of the trimming device 119 by moving the trimming device downwardly and further away from the conveyor which transports the tobacco stream. Such change in the level of the trimming device 119 is ascertained by the monitoring device 179 which transmits an appropriate signal to one input of the stage 181 while the other input of this stage receives (from the transmitter T) a signal denoting the mass of surplus tobacco per unit length of the stream 192*a*. When the difference between the intensities of the two signals exceeds a preselected value, the servomotor 153 receives a signal via amplifier 188 or 189 (depending upon the polarity of the signal) and adjusts the ratio of the transmission 51 (FIG. 2) accordingly to thereby change the rate of tobacco feed by the conveyor 7. The signal which is amplified by the amplifier 188 is used to increase the RPM of the conveyor 7, i.e., to increase the rate of tobacco feed into the stream building zone A of FIG. 3. The transmitter T ensures that the ratio of the transmission 51 is regulated with a view to ensure that the quantity of tobacco in the stream 192*a* will remain constant, namely that it will correspond to the quantity which is determined by the signal from the monitoring device 179 which transmits signals denoting the level of the trimming device 119.

The density of the filler in the cigarette rod increases in response to increasing RPM of the conveyor 7 whereby the monitoring device 129 ascertains such increase of density and transmits an appropriate signal to the stage 176. This results in a lifting of the trimming device 119 closer to the lower reach of the conveyor 17, i.e., close to the neutral position of the trimming device 119. This, in turn, entails a reduction in the mass of tobacco particles per unit length of the stream 192*a* because the changed position of the trimming device 119 is detected by the monitoring device 179 which transmits a modified reference signal to the stage 181. The result is that the servomotor 153 changes the ratio of the transmission 51 in a sense to reduce the RPM of the conveyor 7 and hence the rate of feed of tobacco particles to the stream building zone.

If the density of the filler in the cigarette rod is too high, the monitoring device 129 transmits an appropriate signal to the stage 176 which compares such signal with the reference signal from the source 177 and causes the servomotor 178 to move the trimming device 119 up, i.e., nearer to the conveyor 17. The polarity of the signal which the monitoring device 129 transmits to the stage 176 in response to detection of excessive density is different from that of the signal which is transmitted by the monitoring device 129 when the density of the filler in the cigarette rod is too low. The trimming device 119 is moved from its neutral position, and such change in the level of the device 119 is detected by the monitoring device 179 which transmits a modified reference signal (of different polarity) to the stage 181 and thence to the input b of the servomotor 153 via amplifier 189. The ratio of the transmission 51 is changed in a sense to reduce the RPM of the conveyor 7 and to thus reduce the rate of tobacco feed into the stream building zone. This results in a reduction of the height of the untrimmed tobacco stream and in a reduced compacting of such stream by the suction chamber 18. Furthermore, the less densified stream contains less tobacco subsequent to trimming and the density of the filler in the cigarette rod is reduced. The aforediscussed mode of operation is then repeated if the density of the filler in the rod still exceeds the value which is selected by the source 177 of reference signals, i.e., the servomotor 178 lifts the trimming device 119 again and the speed of the conveyor 7 is again reduced by a step.

It will be noted that, in the machine which embodies the structure of FIG. 4, the trimming device 119 also changes its level (i.e., its distance from the conveyor which accumulates the tobacco stream) but that the trimming device 119 invariably exhibits the tendency to assume its neutral position at a preselected distance from the conveyor 17. In addition, the structure of FIG.

4 ensures that the quantity of tobacco in the stream 192*a* of surplus tobacco is at least substantially constant.

The servomotor 153 of FIG. 4 (or the stage 181) can be used to vary the speed of an electric motor which drives the shaft of the conveyor 7, i.e., the transmission 51 can be omitted. As explained above, the RPM of the conveyor 7 can be increased by electronically changing the control potential for the electric motor which drives the conveyor 7. The average value of the control potential varies as a function of changes in the operating speed of the machine which embodies the structure including an electric motor for transmission of torque to the conveyor 7. The increase or reduction of RPM of the conveyor 7 can be maintained at a constant value by a follow-up RPM regulating circuit.

The just described control system for the level of the trimming device 119 and the quantity of tobacco in the stream 192*a* is preferably used only when the cigarette rod making machine is operated at normal speed. When the speed of the machine deviates from such normal speed, e.g., when the machine is started and is being accelerated to normal operating speed, the position of the trimming device 119 and the rate of feed of surplus tobacco can be set to an average value, e.g., the last value at normal operating speed. Corresponding data can be stored to ensure proper adjustment of the level of the trimming device 119 and of the rate of feed of surplus tobacco during the acceleration stage.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of forming a filler of fibrous material, such as tobacco, on a driven air-permeable conveyor which defines an elongated path, comprising the steps of continuously feeding fibrous material with a surplus over the quantity which is required in the filler at a variable rate into a first portion of the path and attracting the fibrous material to the conveyor by suction so that the resulting stream is densified and advances along said path; removing the surplus from the stream in a second portion of the path downstream of the first portion with attendant conversion of the stream into a filler, including removing fibrous material at a location which is disposed at a variable distance from the conveyor; monitoring the density of the filler and changing the distance between said location and the conveyor when the monitored density deviates from a predetermined value; monitoring the distance between said location and the conveyor; and varying the rate of feed of fibrous material into the first portion of the path as a function of changes in said distance.

2. The method of claim 1, wherein said varying step includes increasing the rate of feed when said distance is changed as a result of a drop of density below said predetermined value and reducing the rate of feed when said distance is changed as a result of a rise of density above said predetermined value.

3. The method of claim 1, further comprising the step of comparing the monitored distance with a predetermined distance, said varying step including increasing or reducing the rate of feed of fibrous material when the difference between the monitored distance and said predetermined distance exceeds a preselected value.

4. The method of claim 1, wherein each variation of the rate of feed of tobacco particles takes up a predetermined interval of time, and further including the step of delaying a next-following variation of said rate of feed following the preceding variation by an interval which at least matches said predetermined interval.

5. The method of claim 1, further comprising the steps of monitoring the quantity of removed surplus and generating a signal when the removed quantity is outside of a predetermined range.

6. The method of claim 1, further comprising the step of accumulating the removed surplus into a second stream, continuously monitoring the quantity of fibrous material in the second stream, and generating a signal when the monitored quantity of tobacco particles in the second stream is outside of a predetermined range.

7. The method of claim 1, wherein said density monitoring step includes directing beta rays against successive increments of the filler and ascertaining the extent of penetration of such rays through the filler.

8. The method of claim 1, wherein said density monitoring step includes directing X-rays against successive increments of the filler and ascertaining the extent of penetration of such rays through the filler.

9. The method of claim 1, wherein said surplus removing step includes mechanically clamping the fibrous material of said location by moving clamping instrumentalities and separating from the stream that material which extends beyond said location in a direction away from the conveyor.

10. The method of claim 1, further comprising the step of temporarily reducing the surplus of fibrous material in the stream which is formed in said path during the initial stage of formation of such stream.

11. The method of claim 1, further comprising the steps of accumulating the removed surplus of fibrous material into a second stream, monitoring the quantity of fibrous material in the second stream and generating first signals denoting the monitored quantity of fibrous material, generating second signals denoting the monitored distance between said location and the conveyor, comparing the characteristics of said first signals with those of said second signals, and varying the rate of feed of fibrous material into the first portion of said path when the characteristics of said first signals deviate from those of said second signals so as to maintain the quantity of fibrous material in the second stream at or close to a preselected value.

12. Apparatus for forming a filler of fibrous material, such as tobacco, comprising an air-permeable conveyor defining an elongated path; a source of fibrous material; a suction chamber at one side of said conveyor opposite said path; adjustable means for feeding fibrous material with a surplus from said source into a first portion of said path at the other side of said conveyor so that the material adheres to the conveyor by suction and forms thereon a stream which advances along said path; a trimming device having means for removing the surplus of fibrous material from the stream at a location which is disposed at a variable distance from the other side of said conveyor and for thereby converting the stream into a filler; means for monitoring the density of the filler downstream of said trimming device, as considered in the direction of movement of fibrous material along said path, and for generating first signals denoting the monitored density of the filler; means for adjusting said trimming device in response to said signals so as to move said location nearer to or further away from said conveyor when the monitored density of the filler deviates from a predetermined value; means for monitoring the distance between said location and said conveyor and for generating second signals denoting the monitored distance; and means for adjusting said feeding means in response to said second signals.

13. The apparatus of claim 12, wherein the means for adjusting said feeding means includes means for increasing the rate of feed when said distance is altered as a result of detection of a drop of density of the filler below said predetermined value and for increasing the rate of feed when said distance is altered as a result of detection of a rise of density above said predetermined value.

14. The apparatus of claim 12, wherein said adjusting means includes a source of reference signals whose characteristics are indicative of a predetermined distance between said location and said conveyor, means for comparing the characteristics of said second signals with those of said reference signals, and means for carrying out the adjustment of said feeding means when the characteristics of said second signals deviate from those of said reference signals to a predetermined extent.

15. The apparatus of claim 12, wherein each adjustment of said feeding means takes up a predetermined interval of time and further comprising means for delaying the next-following of each two successive adjustments of said feeding means for an interval of time which at least matches said predetermined interval.

16. The apparatus of claim 12, further comprising means for monitoring the quantity of the removed surplus.

17. The apparatus of claim 16, further comprising means for generating signals when the monitored quantity of the removed surplus is outside of a predetermined range.

18. The apparatus of claim 12, wherein said density monitoring means comprises a source of X-rays adjacent to one side of the filler and means for ascertaining the intensity of radiation which penetrates through the filler.

19. The apparatus of claim 12, wherein said density monitoring means comprises a source of beta rays adjacent to one side of the filler and means for ascertaining the intensity of radiation which penetrates through the filler.

20. The apparatus of claim 12, wherein said trimming device includes two mobile clamping members arranged to engage the fibrous material at said location and means for segregating from the stream fibrous material which extends beyond such location in a direction away from said conveyor in the region where the stream is engaged by said clamping members.

21. The apparatus of claim 20, wherein said segregating means comprises a paddle wheel.

22. The apparatus of claim 20, wherein said segregating means comprises a rotary brush.

23. The apparatus of claim 12, further comprising means for temporarily reducing the rate of feed of fibrous material upon starting of said feeding means.

24. The apparatus of claim 12, further comprising means for monitoring the quantity of removed surplus material and for generating third signals whose characteristics are indicative of such quantity, and means for comparing the characteristics of said second signals with those of said third signals, said adjusting means being arranged to adjust the rate of feed of fibrous material when the characteritics of said third signals deviate from those of said second signals so that the quantity of removed surplus is a function of the distance between said location and said conveyor.

* * * * *